United States Patent [19]

Silver

[11] 3,976,129

[45] Aug. 24, 1976

[54] SPIRAL CONCENTRIC-TUBE HEAT EXCHANGER

[76] Inventor: Marcus M. Silver, 1904 NE. 52nd St., Seattle, Wash. 98105

[22] Filed: Sept. 16, 1974

[21] Appl. No.: 506,534

Related U.S. Application Data

[63] Continuation of Ser. No. 281,324, Aug. 17, 1972, abandoned.

[52] U.S. Cl. ..... 165/154; 122/266; 138/114; 165/135; 431/157

[51] Int. Cl.[2] ..... F28F 9/00; F28D 7/10

[58] Field of Search ..... 122/33, 266; 138/114; 165/235, 154; 431/157

[56] References Cited

UNITED STATES PATENTS

| | | | |
|---|---|---|---|
| 1,689,461 | 10/1928 | Taylor et al. | 165/154 X |
| 1,800,306 | 4/1931 | Löffler | 165/154 X |
| 2,419,582 | 4/1947 | McCurdy | 122/266 X |
| 3,110,754 | 11/1963 | Witort et al. | 138/114 X |
| 3,443,632 | 5/1969 | Sauer | 165/135 X |
| 3,777,502 | 12/1973 | Michie et al. | 165/154 X |

*Primary Examiner*—Albert W. Davis, Jr.
*Assistant Examiner*—Sheldon Richter
*Attorney, Agent, or Firm*—Robert W. Beach

[57] ABSTRACT

A composite tube composed of an inner tube extending through and spaced from an outer tube by radial partition walls is coiled helically. The helical composite tube coil is housed in a tank having an interior silvered reflective surface and evacuated to minimize heat loss through the tank wall. A carburetor supplies a combustible gas mixture to one end of the inner tube, the gas mixture burns in such tube, and a centrifugal blower draws the combustion gas through the tube. A vaporizable liquid is supplied under pressure to the end of the outer tube adjacent to the centrifugal blower for passage of the vaporizable liquid through the outer tube in the direction opposite the flow of combustion gas through the inner tube for vaporization of the combustible liquid under pressure, such as for producing superheated steam from water.

1 Claim, 3 Drawing Figures

SPIRAL CONCENTRIC-TUBE HEAT EXCHANGER

This is a continuation of application Ser. No. 281,324, filed Aug. 17, 1972 now abandoned.

The present invention relates to a heat exchanger that may be used for a variety of purposes.

A principal object of the heat exchanger is to maximize the efficiency of heat transferred between two fluids at different temperatures, and to minimize heat loss.

Another object is to provide such a heat exchanger which is very compact for its capacity.

More specifically, it is an object to provide a heat exchanger used for the purpose of heating a fluid medium such as for a flash boiler.

A further object is to provide such a heat exchanger which is substantially enclosed in a housing, the exterior of which is at a temperature nearly the same as ambient atmospheric temperature.

Another object is to provide a heat exchanger according to the present invention which is of simple construction and inexpensive to manufacture.

Figure 1:
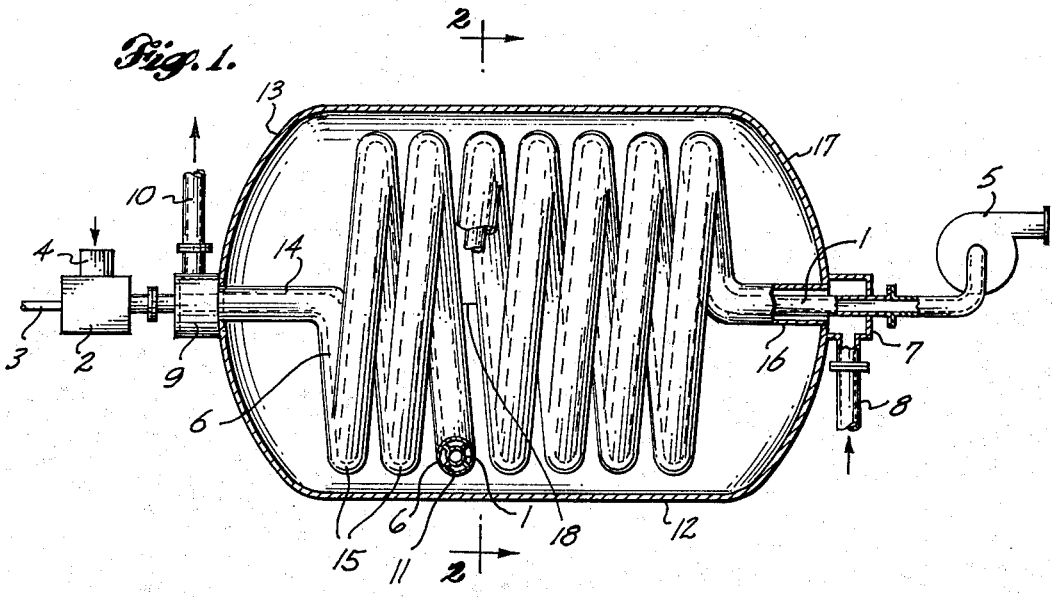
FIG. 1 is an elevation of the heat exchanger with parts broken away.

While the heat exchanger of the present invention can be used for transferring heat from a fluid medium at a temperature much below atmospheric temperature to a fluid medium at a temperature closer to atmospheric temperature, the particular embodiment of the heat exchanger illustrated is used for transferring heat from a fluid medium at a temperature much above atmospheric temperature to a fluid medium at a temperature nearer atmospheric temperature. In the particular embodiment illustrated the fluid medium at a temperature much higher than atmospheric temperature passes through the inner tube 1 of the heat exchanger. Such fluid medium in the particular instance is combustion gas produced by burning a hydrocarbon fuel, preferably of the gaseous type, such as butane or propane.

A combustible mixture is formed in the carburetor 2 of such fuel supplied through the pipe 3 and air supplied through the air intake 4. The combustible mixture is suitably ignited and burns in the inner conduit 1. The combustion gas is drawn through this conduit by suction, such as can be produced by the fan 5, such as of the centrifugal blower type, connected to the end of the inner tube 1 remote from the carburetor tube. The speed and quantity of flow of the combustion gas through the tube can be regulated by controlling the carburetor 2 or by varying the speed of the blower or both. A spark plug or plugs, not shown, or other ignition means can be used to ignite the combustible mixture.

Figure 3:
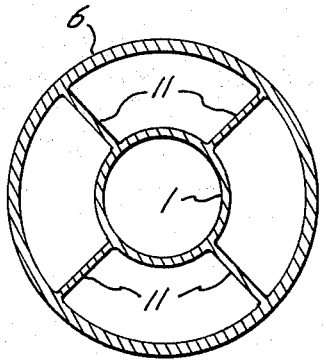
FIG. 3 is an enlarged detail transverse section through the composite tube structure of the heat exchanger.

The inner tube 1 extends through the outer tube 6, as indicated in FIGS. 1 and 3. The space between the end of the outer tube and the discharge end of the inner tube 1 is sealed by a gland 7 to which fluid to be heated is supplied by a conduit 8. The space between the outer tube and the end of the tube 1 to which the combustible mixture is supplied is sealed by a gland 9 from which the heated fluid is discharged through the conduit 10.

The inner tube 1 and the outer tube 6 are held in concentric spaced relationship by spacers 11 extending radially between the inner tube and the outer tube. These spacers could be radial pins or, as shown in FIG. 3, may be radial sheet partitions disposed in radial planes bridging between the inner tube and the outer tube, four of which are shown spaced circumferentially 90° apart. Such partitions can extend continuously between the inner tube and the outer tube and can be formed integrally with the tubes. Such a composite tube can be formed by extrusion and should be made of metal having good heat-conducting properties, such as copper or aluminum.

Figure 2:
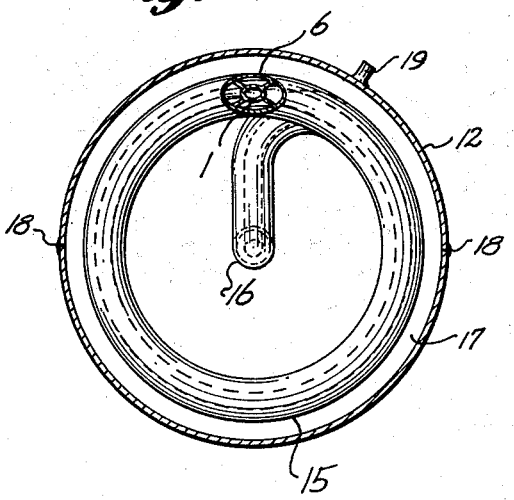
FIG. 2 is a transverse section through the heat exchanger taken on line 2—2 of FIG. 1.

In order for the heat exchanger to be compact so as to be able to be housed within a tank 12, the composite tube 1, 6 is convoluted, such as being wound in a tight helix, as shown in FIGS. 1 and 2. Such helix is arranged concentrically within the central cylindrical portion of the tank 12. A domed end 13 of such tank has a central aperture through which a straight end portion 14 of the outer tube 6 can extend. Such straight portion extends axially from one end of the helical portion 15 of the composite tube.

The opposite straight end portion 16 also extending axially of the tube helix communicates with or passes through a central aperture in the domed end 17 in the opposite end of tank 12. The tank can be assembled around the helically convoluted composite tube 14, 15, 16 by being constructed in symmetrical semicylindrical halves, being divided along a diametral, longitudinal plane as shown, or by a transverse annular seam joining cylindrical sections. Such semicylindrical halves can be assembled in fluidtight relationship by a welded joint 18.

The combustion gas flowing through the inner tube 1, through which heat is transferred to fluid in the space between the inner tube 1 and the outer tube 6, will be hotter than the fluid to which the heat is transferred. To minimize heat loss, however, it is also desirable to deter radiation of heat from the outer wall of the outer tube 6. Deterrence of such radiation can be accomplished by providing a heat-reflective surface on the inner wall of tank 12, such as a silvered surface. Heat loss from tube 6 can be deterred further by substantially evacuating the tank 12. Such evacuation can be accomplished by withdrawing air from a connection 19 to the interior of the tank, which is sealed after such evacuation.

The hot combustion gas from which heat is to be extracted in the heat exchanger flows from left to right, as seen in FIG. 1, through the inner tube 1 as a result of the suction produced by the centrifugal blower 5. Heat will be extracted progressively from the combustion gas as it moves through the tube, so that the temperature of the combustion gas is correspondingly reduced progressively. By introducing the fluid to be heated through the supply conduit 8 to the right end of the space between the inner tube and the outer tube, as seen in FIG. 1, the fluid to be heated will pass through such intertube space from right to left in FIG. 1, counter to the direction of flow of the combustion gas through tube 1. Consequently, the hottest combustion gas will transfer heat to the hottest fluid to be heated at the left end of the composite tube.

While the heat exchanger described above could be used for a variety of purposes, it has particular utility as a flash boiler for supplying superheated vapor to an engine, such as for use in an automotive vehicle. Butane or propane gas will burn in the inner tube 1 substantially completely so as not to produce any appreciable amount of objectionable products of combustion. Vaporizable liquid can be supplied to the connection 8 under pressure greater than atmospheric pressure, which, during its passage through the space between the inner tube 1 and the outer tube 6, can be heated, vaporized and the vapor superheated for discharge through the outlet 10.

The quantity and temperature of the superheated vapor discharged through the connection 10 will depend upon the quantity and pressure of the vaporizable liquid supplied to the connection 8, the relative sizes of the tubes 1 and 6, the length of such tubes, the speed and capacity of the blower 5 drawing the combustion gas through tube 1, and the regulation, capacity and characteristics of the carburetor 2.

Because the inner tube 1 is surrounded completely by the outer tube 6 within the tank 12, all heat removed from the fluid passing through the inner tube is subject to absorption by the fluid in the intertube space between inner tube 1 and outer tube 6. Heat of the fluid within tube 1 is conducted to the outer surface of the tube 1, to the opposite surfaces of partitions 11 and to the inner surface of outer tube 6, from which heat can be picked up by the fluid in the intertube space. The only heat which tends to be lost is that which may radiate from the outer surface of tube 6. Such heat loss is minimized because of the heat-reflective inner surface of tank 12, the evacuation of such tank, and the temperature of the exterior of outer tube 6, which is low as compared to the temperature of the fluid within inner tube 1, i.e. the difference between the temperature of the ambient atmosphere and the temperature of the fluid within the space between the inner and outer tubes is less than the difference between the temperature of the ambient atmosphere and the temperature of the fluid within the inner tube.

I claim:

1. A heat exchanger comprising a helically coiled outer tube, only a single inner tube extending through the interior of said outer tube and helically coiled similar to said outer tube, a plurality of partition sheets spaced circumferentially of said tubes and bridging substantially radially between said single helically coiled inner tube and said helically coiled outer tube, said partition sheets, said single inner tube and said outer tube constituting and extruded integral unit, a sealed cylindrical insulating tank having opposite domed ends and subatmospheric pressure within it, housing said inner and outer tubes helically coiled about the axis of said tank for deterring transfer of heat through the exterior of said outer tube between ambient atmosphere exteriorly of said tank and the fluid in the space between said inner tube and said outer tube, and means supplying fluid to the space between said single inner tube and said outer tube and supplying fluid to the interior of said inner tube such that the difference between the temperature of ambient atmosphere and the temperature of the fluid supplied to the space between said inner tube and said outer tube is less than the difference between the temperature of ambient atmosphere and the temperature of the fluid supplied to the interior of said inner tube, for transfer of heat through the wall of said inner tube between the fluid within said inner tube and the fluid in the space between said inner tube and said outer tube.

* * * * *